US007412807B2

(12) United States Patent
Johnson et al.

(10) Patent No.: US 7,412,807 B2
(45) Date of Patent: Aug. 19, 2008

(54) CABINET DRYER DOOR WITH TRUSS AND METHOD OF USE

(75) Inventors: Troy A. Johnson, Newton, IA (US); Joseph M. Keeler, Colfax, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 642 days.

(21) Appl. No.: 10/893,476

(22) Filed: Jul. 16, 2004

(65) Prior Publication Data

US 2006/0010709 A1 Jan. 19, 2006

(51) Int. Cl.
*E04C 2/34* (2006.01)
*E04C 5/08* (2006.01)
*E06B 3/50* (2006.01)

(52) U.S. Cl. ..... 52/790.1; 52/223.6; 312/109

(58) Field of Classification Search ..... 52/784.1, 52/656.9, 657, 656.4, 291, 742.11, 784.13, 52/223.6, 223.7, 573.1, 455, 790.1, 800.12, 52/800.1, 801.1, 801.11; 49/501; 312/326, 312/329, 109; 244/129.5; 126/191, 192, 126/197; 277/644, 637

See application file for complete search history.

(56) References Cited

U.S. PATENT DOCUMENTS 929,283 A * 7/1909 Budd ..... 52/657
1,328,918 A * 1/1920 Fulda ..... 52/90.1
1,778,013 A * 10/1930 Anderson ..... 52/790.1
1,923,961 A * 8/1933 Wood ..... 52/291
2,612,661 A * 10/1952 Semple ..... 52/790.1
2,630,605 A * 3/1953 Hobson et al. ..... 52/291
2,722,721 A * 11/1955 Carlow ..... 52/291
2,741,808 A * 4/1956 Luther ..... 52/127.12
2,779,980 A * 2/1957 Rhodes ..... 52/291
2,795,015 A * 6/1957 Foley ..... 52/291
3,720,032 A * 3/1973 Harman ..... 428/186
3,893,273 A * 7/1975 Sailor ..... 52/291
4,206,576 A * 6/1980 Walz ..... 52/291
4,747,245 A * 5/1988 Lesmeister et al. ..... 52/309.7
4,878,700 A * 11/1989 Brune ..... 292/241
5,236,392 A * 8/1993 Fauciglietti ..... 52/455
5,243,771 A 9/1993 Kretchman et al.
5,655,351 A * 8/1997 Pohl et al. ..... 52/784.15
6,505,442 B2 1/2003 Banicevic et al.
7,001,001 B1 * 2/2006 Spencer ..... 312/219
2003/0056465 A1 * 3/2003 Banicevic et al. ..... 52/784.1

* cited by examiner

*Primary Examiner*—Robert Canfield
*Assistant Examiner*—Ryan D Kwiecinski
(74) *Attorney, Agent, or Firm*—Clifton Green; Michael D. Lafrenz

(57) ABSTRACT

A cabinet dryer door includes a truss attached to the door to establish seal compression for adequate sealing of the door against the drying cabinet. The inner door has spacers molded into the inner door. The truss cooperates with the spacers to bias the door against the seal. The drying cabinet may utilize a pair of doors with at least one having a truss that establishes a seal compression in both of the doors. The truss is joined to the inner door by a screw located in the center of the truss. The method has the step securing a truss member to the door and curving the door to create a biasing force.

11 Claims, 5 Drawing Sheets

CABINET DRYER DOOR WITH TRUSS AND METHOD OF USE

BACKGROUND OF THE INVENTION

The present invention relates generally to truss systems for reinforcing appliance or cabinet doors and specifically to a door truss for use with a drying cabinet appliance and method of use.

Drying cabinets provide hot air for drying clothes hanging in the cabinet. Drying cabinets can be used for dewrinkling clothes by providing steam into the cabinet to remove wrinkles. Drying cabinets may be used in combination with a tumble dryer and when placed on top of the tumble dryer, preferably have door handles on the front bottom portion of the cabinet doors. However, the drying cabinet makes use of relatively tall and thin doors. Without adequate support, the doors will flex during opening. This flex creates a non-rigid feel to the user which may be perceived as poor quality construction.

In addition, the tall cabinet doors having a handle at the bottom have a potential problem of inadequate seal compression at the upper end of the doors. Although the lower ends of the doors may be adequately fastened or latched, the upper ends may be loose as there is no comparable latch at the upper ends.

A still further problem of drying cabinet doors is maintaining the shape of the doors. Each door normally includes a plastic inner door liner and an outer metal skin. In order to have adequate compression seal around the perimeter of the door, the shape of the inner and outer door panels must be maintained.

Accordingly, the primary objective of the present invention is the provision of an improved cabinet dryer door.

Another objective of the present invention is the provision of a cabinet dryer door truss system for reduced flexing of the door during opening and closing of the cabinet door.

Another objective of the present invention is the provision of a cabinet door that may be latched at the bottom yet still provide adequate seal compression at the top of the door.

Another objective of the present invention is the provision of a cabinet or appliance door having a sheet metal skin on an inner plastic liner which is assembled to maintain a preloaded shape for the assembled door.

A further objective of the present invention is the provision of an improved appliance door having sufficient seal compression around the perimeter of the door.

Still another object of the present invention is the provision of an improved appliance door which is economical to manufacture and durable in use.

These and other objectives will become apparent from the following description of the invention.

SUMMARY OF THE INVENTION

The foregoing objectives may be achieved with a door assembly for an appliance or cabinet having a plastic inner door panel and a metal outer door panel. Spacers molded into the inner door and a truss system attached to the inner door cooperate to establish seal compression between the closed door and the drying cabinet.

According to another aspect of the present invention, the truss may be attached to the inner door by a screw placed into a hole approximately centered in the truss.

According to another feature of the present invention, the door assembly has a block spacer between the inner door panel and the outer skin panel. The block spacer provides curvature to the outer skin similar to the curvature of the inner door.

According to yet another feature of the present invention, the truss positioned within the door assembly is a bar received into slots in the spacers so as to be supported by the spacers.

The foregoing objectives may also be achieved with a drying cabinet having a housing and a pair of center opening doors attached to the housing. The doors have a handle at the bottom of the doors and a truss within at least one door. The truss is secured to the door to preload the door and thereby establish a seal compression around the doors for adequate sealing of the doors against the housing.

The foregoing objectives may also be achieved by a method of generating a preload on a cabinet door to provide sealing compression. The method has the steps securing a truss member to the door and maintaining the truss member in a straight profile while curving the door for a biasing effect against a seal.

DETAILED DESCRIPTION OF THE PREFERRED EMBODIMENT

Figure 1:
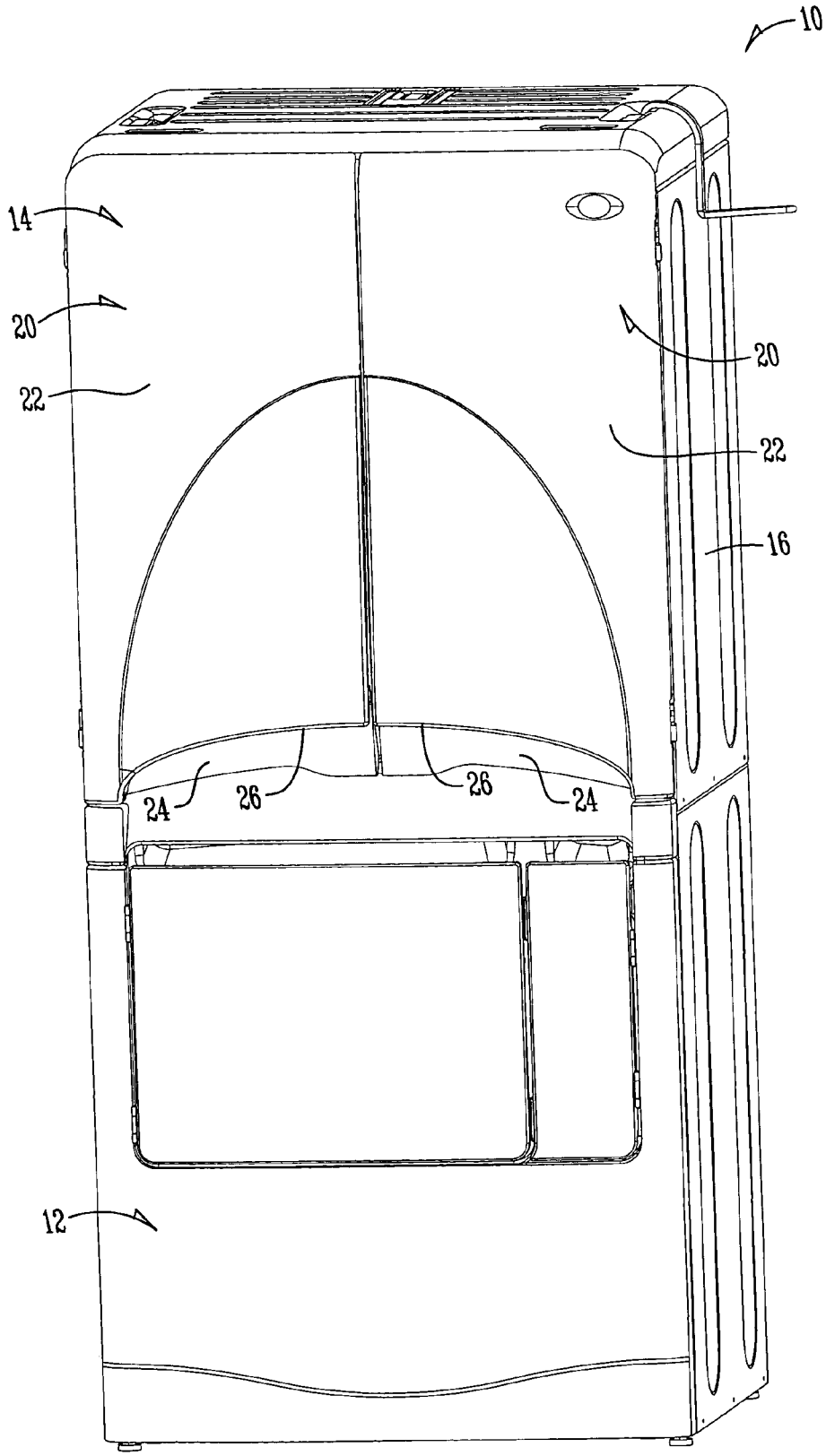
FIG. 1 is a perspective view of a clothes drying machine having a drying cabinet located on top of a tumble dryer and showing the doors in a closed position.
Figure 2:
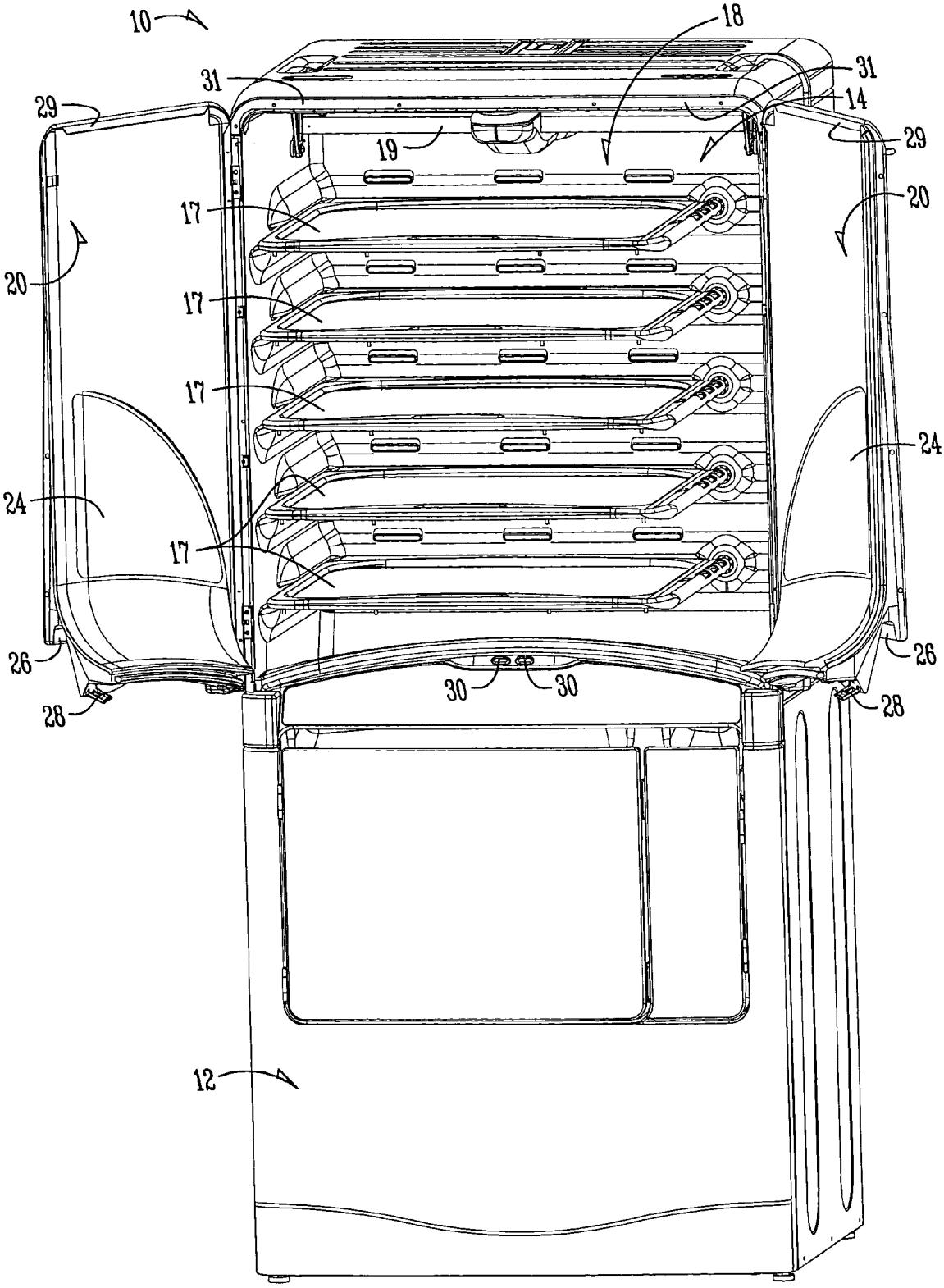
FIG. 2 is a view similar to FIG. 1 showing the doors opened.

FIGS. 1 and 2 shows a combination clothes drying machine 10 having a tumble dryer 12 and a drying cabinet 14. The tumble dryer 12 and cabinet dryer 14 are housed within a cabinet or housing 16 so as to define a single appliance with dual functions. The drying cabinet 14 is shown to be mounted on top of the tumble dryer 12, though it is understood that other configurations can be provided, and includes a drying compartment or chamber 18. As seen in FIG. 2, the drying cabinet 16 may include removable shelves 17 and a hanging bar 19 to hold clothes on hangers.

The drying cabinet 14 includes a pair of doors or door assemblies 20 which provide access to the drying compartment 18. The right and left doors 20 are mirror images of one another. The right door has an emblem in the upper right hand corner. Each door assembly 20 has a metal outer skin or panel 22 that attaches to a plastic inner door panel 24. The outer skin 22 is a sheet metal. A handle 26 is formed near the bottom of the inner door 24. Each door assembly 20 is relatively tall and narrow and encounters torque when the door assembly 20 is opened using the handle 26. A door strike 28 is provided on the inner panel 24. The door strike 28 is received in latch 30 on the drying cabinet 14 to maintain the doors 20 in a closed position.

The location of the handle 26 and door strike 28 at the bottom of each door assembly 20 presents the problem of providing adequate seal compression at the top of the door assemblies 20. Thus, a truss member 32 is provided to preload at least one door assembly 20 and bias the top 29 slightly against the seal 31 when the door assembly 20 is in the closed position.

Figure 3:
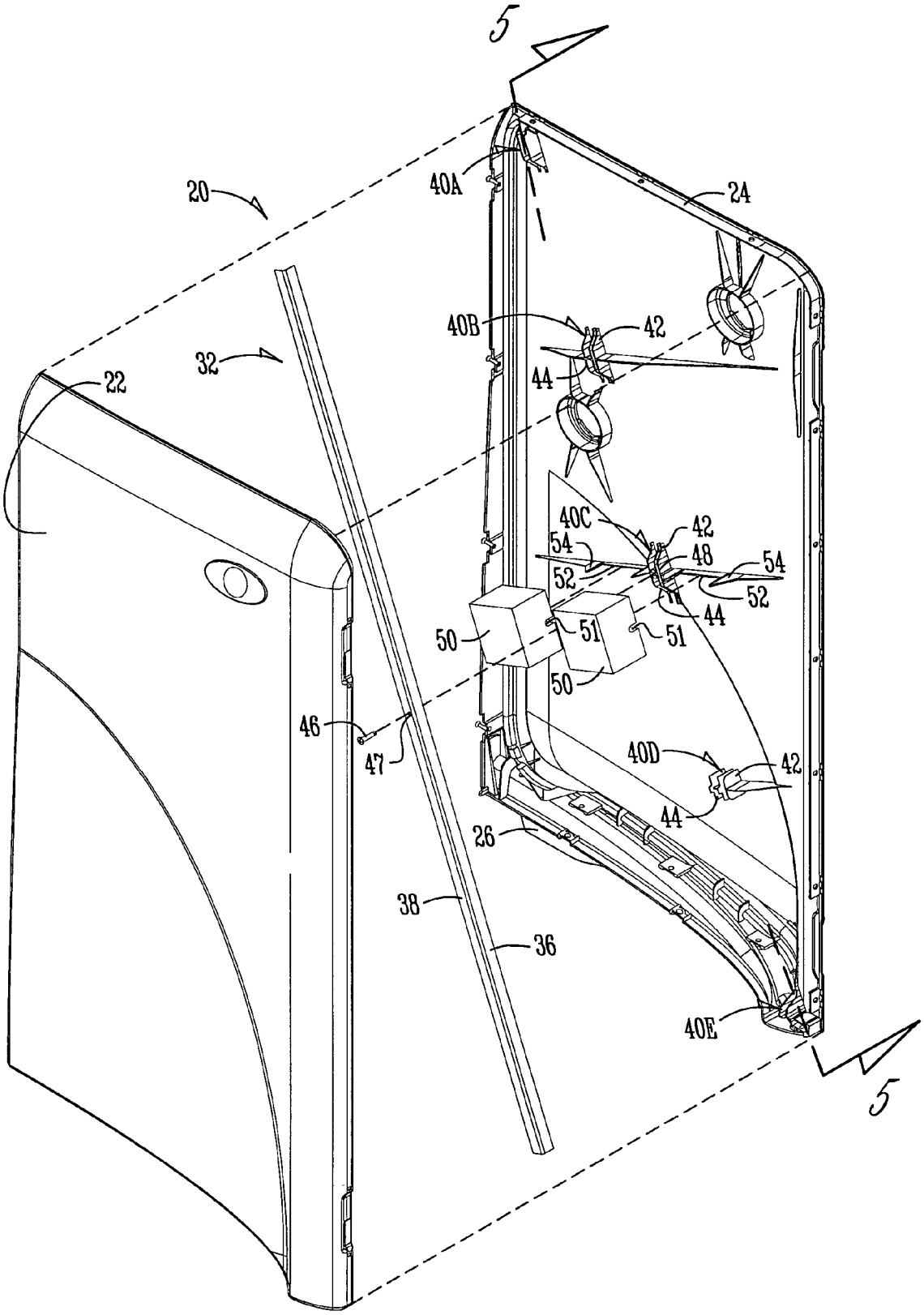
FIG. 3 is an exploded perspective view of a door assembly of the present invention.
Figure 4:
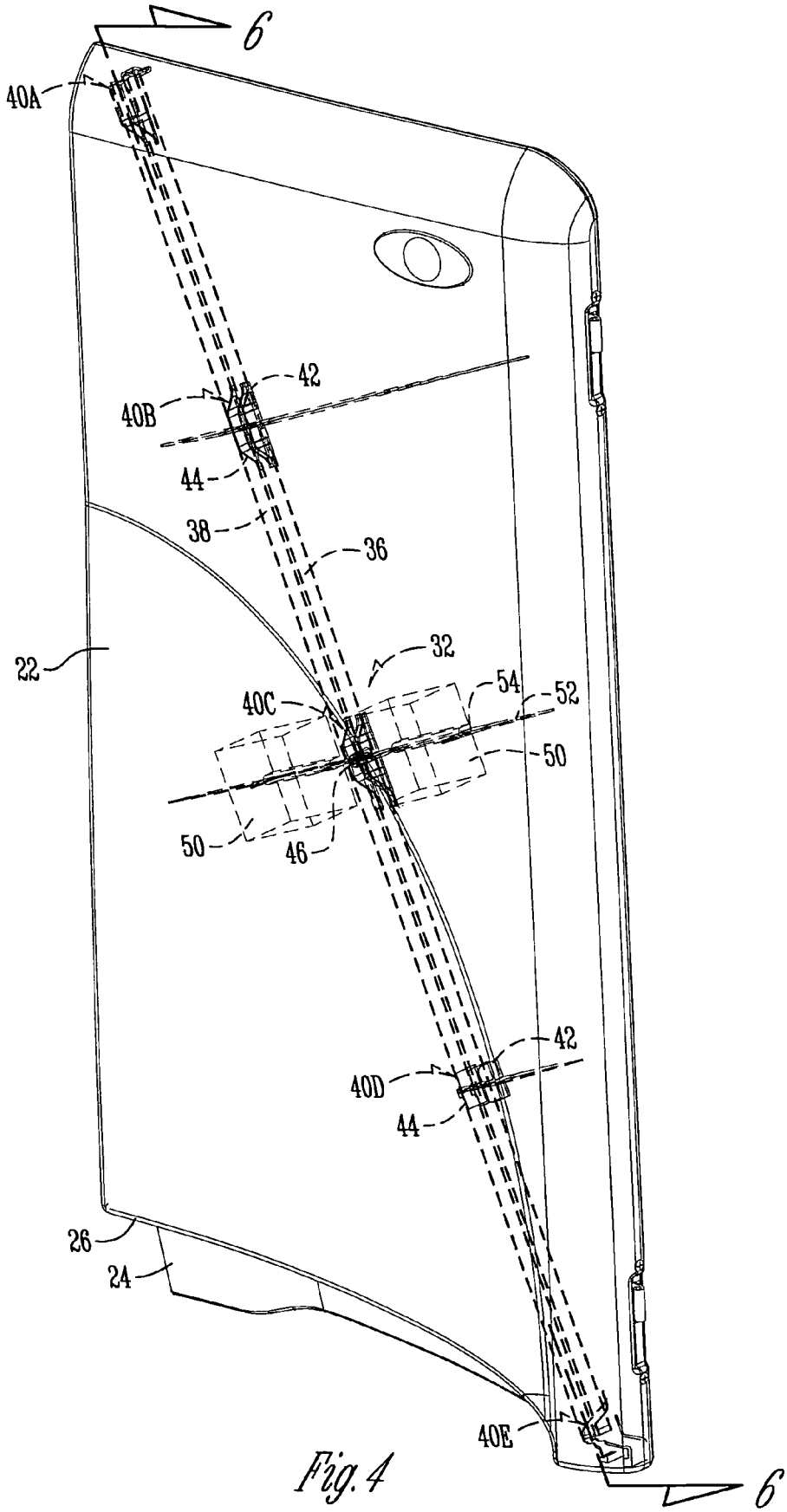
FIG. 4 is a view similar to FIG. 3 showing a door in the assembled state.

As seen in FIGS. 3 and 4, the truss member 32 is an angle iron having a first leg 36 and second leg 38 formed at an approximately 90 degree angle. The truss member 32 is made out of metal, typically commercial steel. The truss member 32 may be hot dipped galvanized steel that is 0.052 inches thick.

While the truss member 32 is illustrated as an angle iron, it may be employed in various other structural shapes to create a relatively inflexible member. These shapes include, but are not limited to, flat bar, C-channel and tubular shapes.

The truss member 32 is placed adjacent spacers 40 formed in the inner panel 24. The truss member 32 and spacers 40 are located diagonally across the inner door panel 24 running from a bottom corner opposite the door strike 28 to a top corner. The spacers 40 have opposite walls 42, 44 defining a slot that receives the first leg 36 of the truss member 32.

A screw 46 is provided to attach the truss member 32 to the inner door panel 24. The screw 46 goes through hole 47 approximately centered in the truss member 32 to attach to screw boss 48 on the inner panel 24. As the screw 46 is tightened, the inner door panel 24 flexes to be drawn into its final position against the relatively inflexible truss member 32.

Blocks 50 are used to space the outer skin panel 22 from the inner door panel 24. The blocks 50 each have a slot 51 for mounting upon ribs 52 formed on the inner door panel 24 and are prevented from side movement by jaws 54. As the screw 46 is tightened the inner door panel 24 is drawn upward to abut the truss member 32 and the blocks 50 raise with the inner door panel 24 so that the shape of the inner door panel 24 is conveyed to the outer skin panel 22. Using blocks 50, the same preloaded shape is maintained in both the inner door panel 24 and the outer skin panel 22 of the door assembly 20.

Figure 5:
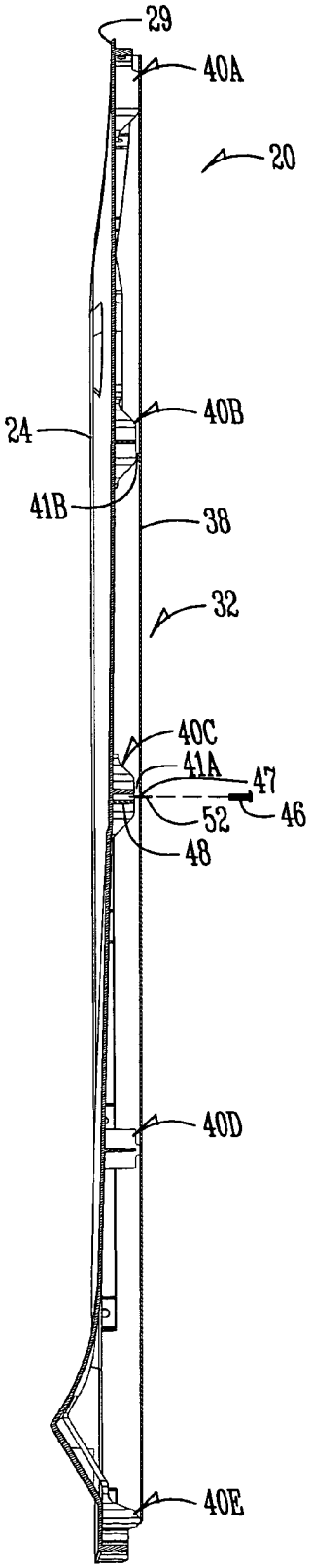
FIG. 5 is a sectional view taken along line 5-5 of FIG. 3 additionally including a sectional view of the truss member in position on the spacers.

FIG. 5 is a cross section of FIG. 3 but having the truss 32 adjacent the spacers 40. The spacers 40 have varying heights. Spacers 40A, 40D, and 40E are slightly taller than 40B and 40C. This height difference creates space 41A between the truss 32 and the spacer 40C and space 41B between the truss 32 and spacer 40B. These spaces remain as long as the inner door panel 24 does not have a load applied to the spacer 40C by the screw being tightened into screw boss 48. As illustrated in FIG. 5, there is no bias outward away from the top 29 of the inner door panel 24.

Figure 6:
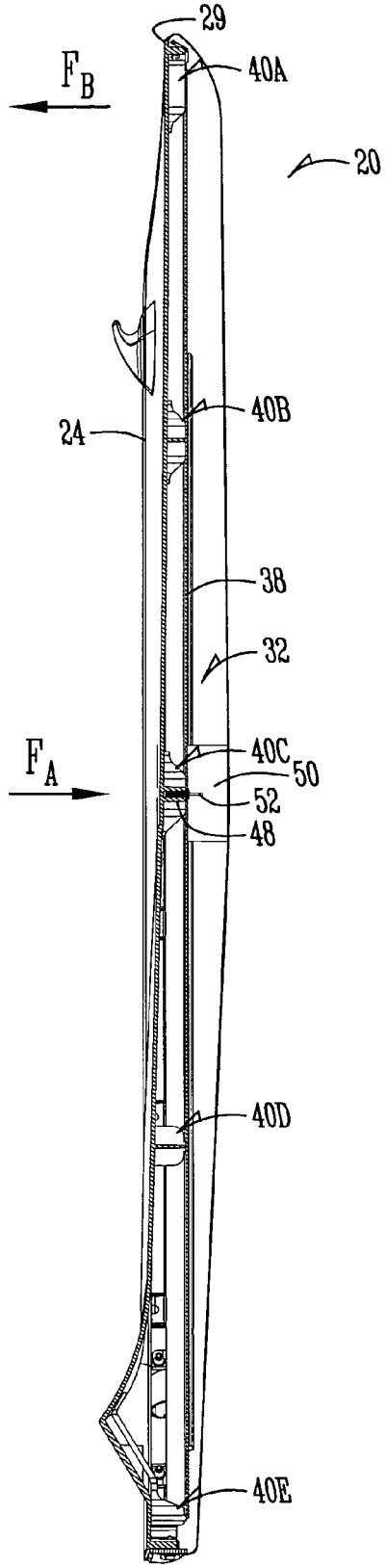
FIG. 6 is a sectional view taken along line 6-6 of FIG. 4.

FIG. 6 is a cross section of FIG. 4. The screw 46 has been inserted into the screw boss 48 drawing the inner door panel 24 inward by force $F_a$. Force $F_a$ draws the inner door 24 into the truss 32 to remove gaps 41A and 41B and slightly bend the inner door 24. Force $F_a$ creates an outward bias force $F_b$ at the top 29 of the door assembly 20. These forces cooperate with the door strike 28 and latch 30 of the drying cabinet 14 to maintain the doors in the closed position.

The truss member 32 is illustrated in use on the right door assembly 20. Alternatively, the truss member 32 may be on both the left and right door assemblies 20. Typically, the drying cabinet 14 is designed such that one door assembly 20 closes over the other to form a seal. When only one truss member 32 is used, the truss 34 is preferably upon the side of the drying cabinet 14 that closes over the other side. As illustrated in the Figures, the right side door of the drying cabinet 14 closes over left side door and therefore the right side door would preferably have the truss member 32. Even if the truss member 32 is not used within a door assembly 20, the blocks 50 are still utilized to create curvature of the outer skin panel 22.

In operation, the user will grip the handle 26 as seen in FIG. 1 and pull outward to open the door assembly 20. The outward force by the user disengages the door strike 28 from the latch 30 permitting separation of a seal at the top of the door assembly 20. The user rotates the door assembly 20 away from the centerline of the drying cabinet 14 and the door assembly 20 is prevented from flexing by the truss member 32. The user then loads the drying cabinet with articles of clothing upon removable shelves 17 and the hanging bar 19. The user rotates the door assembly 20 toward the centerline of the drying cabinet 14 and the door assembly 20 is prevented from flexing by the truss member 32. The user then presses the door strike 28 into the latch 30 which concurrently engages a seal at the top of the door assembly 20 assisted in part by the seal compression created by the truss assembly 32. Throughout opening and closing, the user is assured that the door assembly 20 is sealed prior to opening, rigid when being opened or closed, and secured and sealed after closing.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A door assembly for an appliance with a cabinet, the door assembly comprising:

a door adapted to be attached to the cabinet for movement between open and closed positions;

at least three spacers molded into the door, the first and second spacers located adjacent diagonally opposite first and second corners of the door respectively, and the third spacer located between the first and second spacers, the first and second spacers taller in height than the third spacer; and a truss located on the at least three spacers and secured to the door adjacent the third space so as to cooperate with the spacers to establish a preload on the door, and thereby provide seal compression for adequate sealing of the door against the cabinet when the door is in the closed position.

2. The door assembly of claim 1 wherein the truss is attached to the door by a screw placed into a hole approximately centered in the truss.

3. The door assembly of claim 2 wherein the screw draws the door into a final position to establish the preload.

4. The door assembly of claim 1 further comprising an outer panel and an inner panel attached to the outer panel.

5. The door assembly of claim 4 further comprising a block spacer between the inner panel and the outer panel to provide curvature to the outer panel.

6. The door assembly of claim 5 wherein the curvature of the outer panel is approximately the same curvature of the inner panel.

7. The door assembly of claim 1 wherein the truss is an angle iron having a first and second legs joined at approximately a 90 degree angle.

8. The door assembly of claim 7 wherein the spacers have a slot to receive one of the legs of the truss.

9. The door assembly of claim 8 wherein the truss maintains the spacers substantially straight.

10. The door assembly of claim 1 further comprising a latch located adjacent a third corner of the door for maintaining the door in a closed position.

11. The door assembly of claim 10 further comprising a handle located adjacent the third corner of the door.

* * * * *